US005468586A

United States Patent [19]

Proper et al.

[11] Patent Number: 5,468,586

[45] Date of Patent: Nov. 21, 1995

[54] SYSTEM FOR CONTROLLING THE COLOR OF TONER MIXTURES

[75] Inventors: James M. Proper; Peter F. Erhardt, both of Webster, N.Y.

[73] Assignee: Xerox Corporation, Stamford, Conn.

[21] Appl. No.: 247,821

[22] Filed: May 23, 1994

[51] Int. Cl.[6] ..... G03G 9/09

[52] U.S. Cl. ..... 430/137; 430/106

[58] Field of Search ..... 264/105; 430/137, 430/106

[56] References Cited

U.S. PATENT DOCUMENTS

| | | | |
|---|---|---|---|
| 3,778,287 | 12/1973 | Stansfield et al. | 106/308 |
| 4,054,465 | 10/1977 | Ziobrowski | 106/298 |
| 4,247,338 | 1/1981 | Ziobrowski | 106/298 |
| 4,894,308 | 1/1990 | Mahabadi et al. | 430/137 |
| 4,973,439 | 11/1990 | Chang et al. | 264/101 |
| 5,145,762 | 9/1992 | Grushkin | 430/137 |
| 5,262,268 | 11/1993 | Bertrand et al. | 430/137 |

*Primary Examiner*—John Goodrow
*Attorney, Agent, or Firm*—John S. Wagley

[57] ABSTRACT

An apparatus for the preparation of a mixture of toner resin and a liquid colorant. The apparatus includes a toner extruder having the resin being conveyed therethrough and a colorant adder for adding the colorant to the toner resin in the toner extruder to form the toner mixture.

9 Claims, 4 Drawing Sheets

SYSTEM FOR CONTROLLING THE COLOR OF TONER MIXTURES

The present invention relates to a method and apparatus for manufacturing toners. More particularly, the invention relates to an apparatus and method for adding colorant to toner resin.

In the process of electrophotographic printing, a photoconductive surface has an electrostatic latent image recorded therein. Toner particles are attracted from carrier granules to the latent image to develop the latent image. Thereafter, the toner image is transferred from the photoconductive surface to a sheet and fused thereto.

Typically, toner may be produced by melt-mixing the soft polymer and pigment whereby the pigment is dispersed in the polymer. The polymer having the colorant dispersed therein is then pulverized.

The following disclosures may be relevant to various aspects of the present invention:

U.S. Pat. No. 5,262,268 Patentee: Bertrand et al. Issue Date: Nov. 16, 1993

U.S. Pat. No. 5,145,762 Patentee: Grushkin Issue Date: Sep. 8, 1992

U.S. Pat. No. 4,973,439 Patentee: Chang et al. Issue Date: Nov. 27, 1990

U.S. Pat. No. 4,894,308 Patentee: Mahabadi et al. Issue Date: Jan. 16, 1990

U.S. Pat. No. 4,247,338 Patentee: Ziobrowski Issue Date: Jan. 27, 1981

U.S. Pat. No. 4,054,465 Patentee: Ziobrowski Issue Date: Oct. 18, 1977

U.S. Pat. No. 3,778,287 Patentee: Stansfield et al. Issue Date: Dec. 11, 1973

The relevant portions of the foregoing disclosures may be briefly summarized as follows:

U.S. Pat. No. 5,262,268 (Bertrand et al.) discloses a method of pigment dispersion in colored toner in which a pigment wet cake is blended and extruded directly with a resin and other constituents in the manufacture of a toner. In this process, the pigments are created in a chemical reaction in an aqueous phase. The pigment particles are filtered and washed. In the pigment manufacturing process, an aqueous slurry called a wet cake may be produced which is about 40% to about 85% by weight water, with about 50% by weight water being typical.

U.S. Pat. No. 5,145,762 (Grushkin) discloses a process for the preparation of toner compositions. The process comprises melt blending toner resin particles, magnetic particles, wax, and charge additives. The process further comprises adding a coupling component to the aforementioned mixture, injecting water therein, and cooling.

U.S. Pat. No. 4,973,439 (Chang et al.) discloses an apparatus for obtaining toner particles with improved dispersion of additive components therein comprised of a toner extrusion device containing therein a blending chamber, a mixing screw, a heater, a toner supply, and an injector for injecting additive components including charge control agents into the extrusion device enabling a decrease in the melting temperature of the toner resin particles contained therein.

In U.S. Pat. No. 4,894,308 (Mahabadi et al.), a process for preparing an electrophotographic toner is disclosed which comprises premixing and extruding a pigment, a charge control additive and a resin. The pigment and the charge control additive may be premixed prior to being added to the extruder with the resin; alternatively, the pigment and charge control additive may be premixed by adding them to the extruder via an upstream supply means and extruding them, and subsequently adding the resin to the extruder via a downstream supply means.

U.S. Pat. No. 4,247,338 (Ziobrowski) discloses a metal chromate pigment composition, particularly a lead chromate composition, which exhibits low dusting characteristics and improved heat stability in thermoplastics. The pigment particles are treated with a combination of certain metal salts or fatty acids and plasticizers. The lead chromate particles with or without a silica or silica aluminum coating are in the form of a ground dried lump, wet calve, a slurry of the pigment in water or a suitable organic diluent. The pigment, fatty acid and plasticizer are mixed. In the examples given in the patent, the pigments, except for one of the control pigments, are pretreated prior to being dry blended with commercial polypropylene pellets, passing the blended sample thrice through an extruder.

U.S. Pat. No. 4,054,465 (Ziobrowski) discloses lead chromate-containing pigments having improved dispersibility, heat stability and resistance to abrasion in thermoplastic systems. The pigments comprise silica coated lead chromate-containing particles having absorbed on their surface from 1–15% based on the weight of the coated particles of certain liquid organopolysiloxanes. The improved lead chromate-containing pigments of this invention are produced by depositing on the lead chromate-containing particles at least one substantially continuous coating of dense amorphous silica, with or without alumina, or a solid glass-like alkali polysilicate, and contacting the coated particles with certain liquid organopolysiloxanes. Following application of the silica coating to the lead chromate particles, the coated particles are contacted with a liquid organopolysiloxane under conditions which do not effect substantial polymerization a curing of the polysiloxane. The coated pigment can be in the form of a ground dried lump, a wet cake, a slurry of the coated pigment in water, or an inert organic diluent. The mixture is ground or vigorously agitated at room temperature in a blender. The liquid polysiloxane can also be applied directly, as by sprinkling on the dry coated pigment and then grinding wetted pigment in a high speed grinding device.

In U.S. Pat. No. 3,778,287 (Stansfield et al.) dispersions of inorganic pigments, lakes or toners in organic liquids containing polyesters dissolved therein having acid values up to 100 derived from certain hydroxy-containing, saturated or unsaturated aliphatic carboxylic acids are described. While liquid colorants offer the distinct advantage of being more readily incorporated into the medium to be colored than dry pigments, their commercial significance is seriously limited due to the problems of handling and storing potentially hazardous liquid chemicals. Thus, from an economic and safety standpoint, it is desirable to have the colorants in a dry, storage stable form which is readily dispersible in a wide variety of coating media without detriment to any of the desirable properties of coating produced therefrom.

In accordance with one aspect of the present invention, there is provided an apparatus for the preparation of a mixture of toner resin and a liquid colorant. The apparatus comprises a toner extruder having the resin being conveyed therethrough and a colorant adder for adding the colorant to the toner resin in the toner extruder to form the toner mixture.

In accordance with another aspect of the present invention, there is provided a method for the preparation of toner compositions with a mixture of toner resin and a liquid colorant. The method comprising the steps of conveying the toner resin through an extruder and adding the colorant to the toner resin in the extruder to form the toner mixture.

The invention will be described in detail herein with reference to the following Figures in which like reference numerals denote like elements and wherein.

Figure 1:
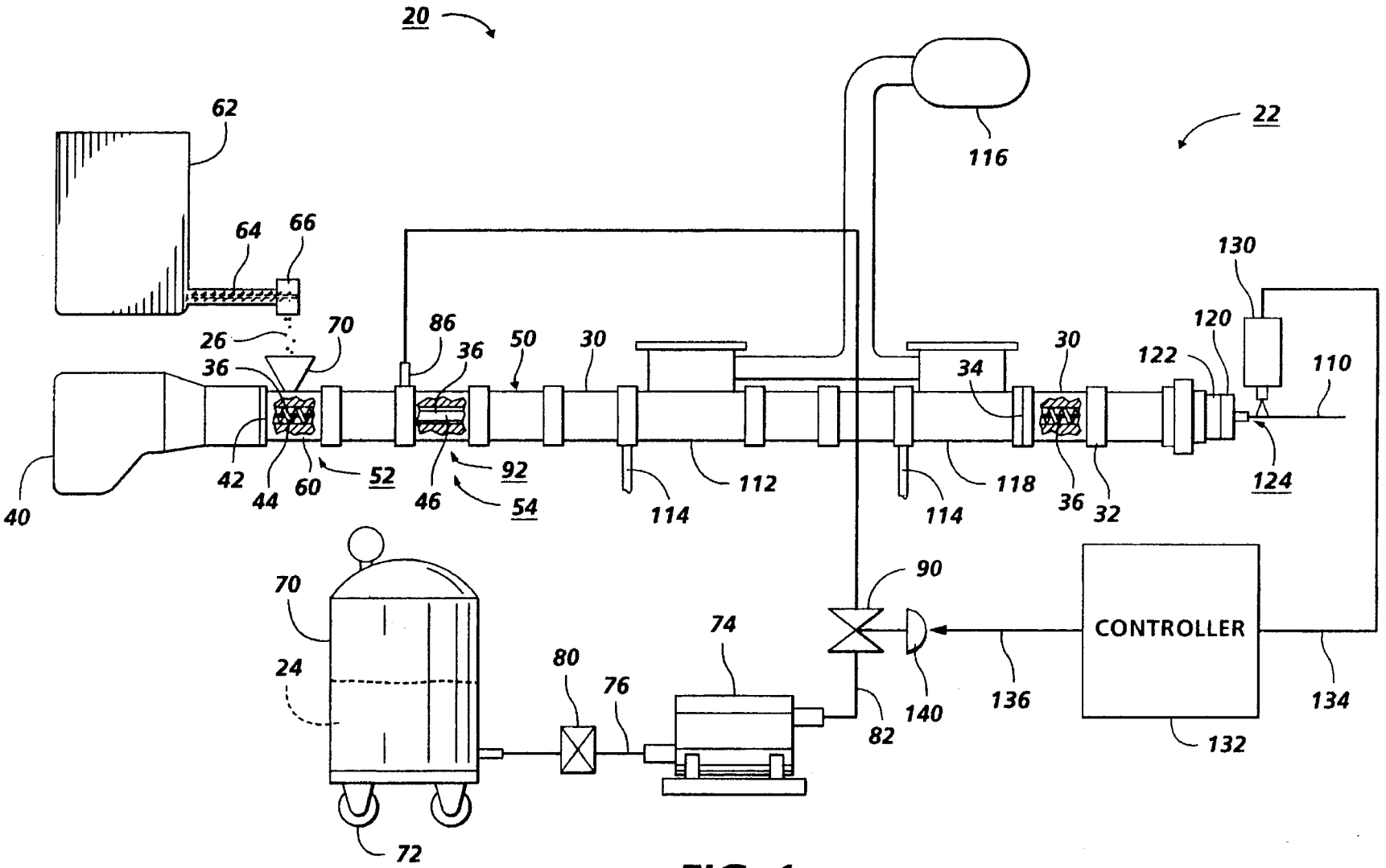
FIG. 1 is a schematic elevational view of an extruder utilizing the colorant injection system of the present invention.

According to the present invention, the toner created by the process of this invention comprises a resin, a colorant, and preferably a charge control additive and other known additives. The colorant is a particulate pigment, or alternatively in the form of a dye. By using a dye instead of obtaining a more refined version of the pigment colorant, the costs of manufacturing the toner may be somewhat reduced. The use of aqueous dispersed pigments and dyes in this process eliminates the need for the use of toxic solvents.

Numerous colorants can be used in this process, including but not limited to:

| Pigment Brand Name | Manufacturer | Pigment Color Index |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow TY-858-D | Heubach | Yellow 74 |
| Hansa Yellow X | Hoechst | Yellow 75 |
| Novoperm ® Yellow HR | Hoechst | Yellow 75 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |
| L75-2377 Yellow | Sun Chem. | |
| Hostaperm ® Orange GR | Hoechst | Orange 43 |
| Paliogen ® Orange | BASF | Orange 51 |
| Irgalite ® 4BL | Ciba-Geigy | Red 57:1 |
| Fanal Pink | BASF | Red 81 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901 F | BASF | Blue 15:2 |
| Heliogen ® Blue NBD 7010 | BASF | |
| Heliogen ® Blue K 7090 | BASF | Blue 15:3 |
| Heliogen ® Blue K 7090 | BASF | Blue 15:3 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |

-continued

| Pigment Brand Name | Manufacturer | Pigment Color Index |
|---|---|---|
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | |
| Mogul L | Cabot | |
| BK 8200 Black Toner | Paul Uhlich | |

Any suitable toner resin can be mixed with the colorant by the downstream injection of the colorant dispersion. Examples of suitable toner resins which can be used include but are not limited to polyamides, epoxies, diolefins, polyesters, polyurethanes, vinyl resins and polymeric esterification products of a dicarboxylic acid and a diol comprising a diphenol. Any suitable vinyl resin may be selected for the toner resins of the present application, including homopolymers or copolymers of two or more vinyl monomers. Typical vinyl monomeric units include: styrene, p-chlorostyrene, vinyl naphthalene, unsaturated mono-olefins such as ethylene, propylene, butylene, and isobutylene; vinyl halides such as vinyl chloride, vinyl bromide, vinyl fluoride, vinyl acetate, vinyl propionate, vinyl benzoate, vinyl butyrate, and the like; vinyl esters such as esters of monocarboxylic acids including methyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylimide; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; styrene butadiene copolymers, Pliolites, available from Goodyear Company, and mixtures thereof.

Particularly preferred are resins comprising a copolymer of styrene and butadiene which comprises 89 percent by weight of styrene and 11 percent by weight of butadiene, and a copolymer of styrene and n-butyl methacrylate which comprises 58% by weight of styrene and 42 percent by weight of n-butyl methacrylate.

The resin or resins are generally present in the resin-toner mixture in an amount of from about 50 percent to about 100 percent by weight of the toner composition, and preferably from about 80 percent to about 100 percent by weight.

Additional components of the toner may be added to the resin prior to mixing the resin with the colorant. Alternatively, these components may be added during extrusion. Some of the additional components may be added after extrusion, such as the charge control additives, particularly when the pigmented toner is to be used in a liquid developer. These components include but are not limited to stabilizers, waxes, and charge control additives.

Various known suitable effective charge control additives can be incorporated into the toner compositions of the present invention, such as quaternary ammonium compounds and alkyl pyridinium compounds, including cetyl pyridinium halides and cetyl pyridinium tetrafluoroborates, as disclosed in U.S. Pat. No. 4,298,672, the disclosure of which is totally incorporated herein by reference, distearyl dimethyl ammonium methyl sulfate, and the like. Particularly preferred as a charge control agent is cetyl pyridinium chloride. The charge enhancing additives are usually present in the final toner composition in an amount of from about 1 percent by weight to about 20 percent by weight.

Other additives may also be present in toners obtained by the process of the present invention. External additives may be applied, for example, in instances such as when toner flow is to be assisted, or when lubrication is needed to assist a function such as cleaning of the photoreceptor. The amounts of external additives are measured in terms of percentage by weight of the toner composition, but are not themselves included when calculating the percentage composition of the toner. For example, a toner composition containing a resin, a colorant, and an external additive may comprise 80 percent by weight resin and 20 percent by weight colorant; the amount of external additive present is reported in terms of its percent by weight of the combined resin and colorant.

External additives may include any additives suitable for use in electrostatographic toners, including fumed silica, silicon derivatives such as Aerosil® R972, available from Degussa, Inc., ferric oxide, hydroxy terminated polyethylenes such as Unilin®, polyolefin waxes, which preferably are low molecular weight materials, including those with a molecular weight of from about 1,000 to about 20,000, and including polyethylenes and polypropylenes, polymethylmethacrylate, zinc stearate, chromium oxide, aluminum oxide, titanium oxide, stearic acid, polyvinylidene fluorides such as Kynar, and other known or suitable additives. External additives may be present in any amount, provided that the objectives of the present invention are achieved, and preferably are present in amounts of from about 0.1 to about 1 percent by weight. For the process of the present invention, these additives may preferably be introduced onto the toner particles after mixing with the colorant and subsequent pulverization and classification.

Figure 2:
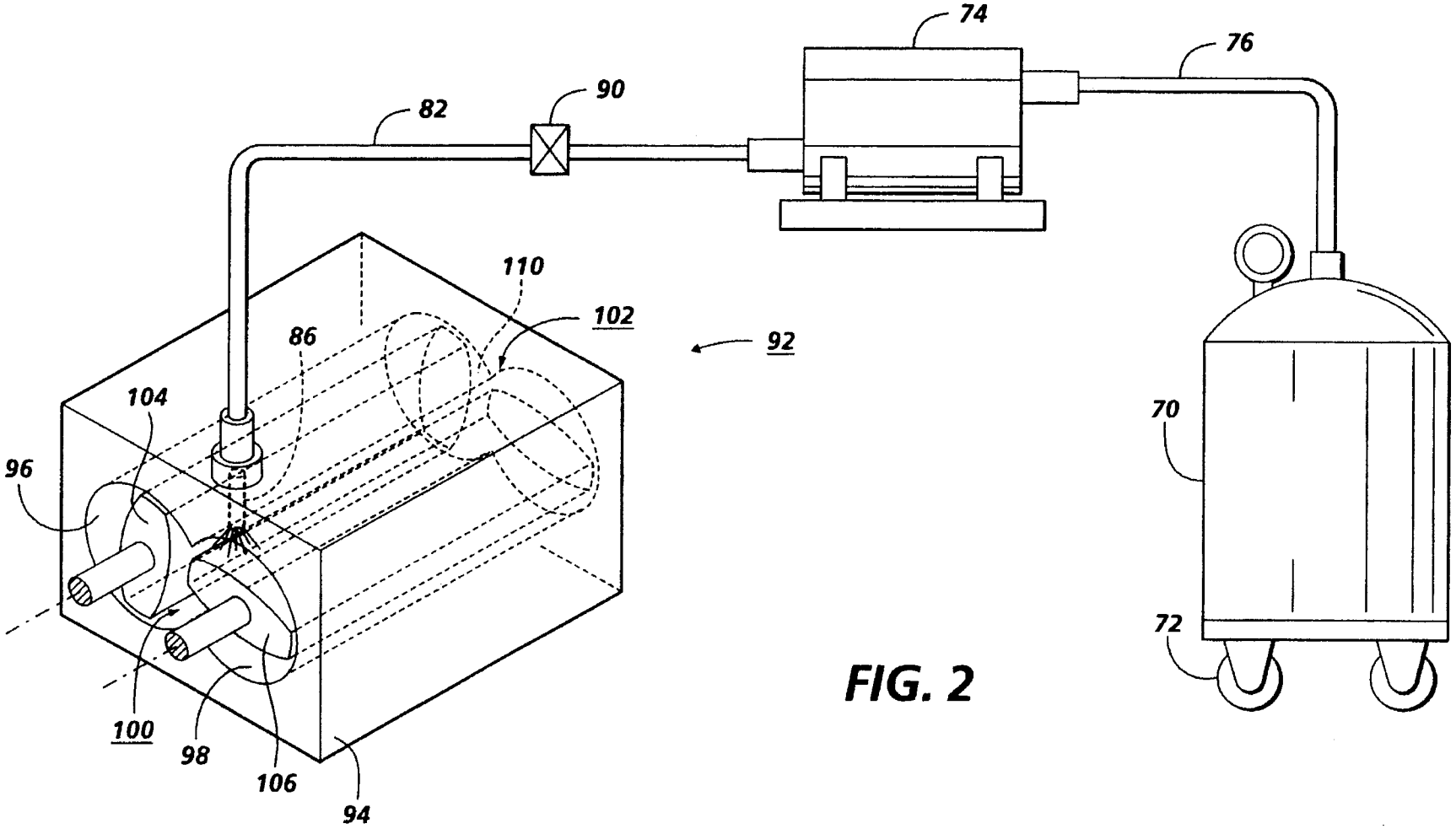
FIG. 2 is a schematic view partial in elevation and partial in perspective of the colorant injection system of FIG. 1.

Referring first to FIG. 1, a toner preparing apparatus 20 in the form of an extruding system is shown. The toner preparing apparatus 20 includes an extruder 22 for mixing colorant 24 with dry resin 26 and for converting the dry resin 24 into a liquid form. Generally, any extruder, such as a single or twin screw extruder, suitable for preparing electrophotographic toners, may be employed for mixing the colorant 24 with the resin 26. For example a Werner Pfleiderer WP-28 extruder equipped with a 15 horsepower motor is well-suited for melt-blending the resin 26, a colorant 24, and additives. This extruder has a 28 mm barrel diameter, and is considered semiworks-scale, running at peak throughputs of about 3 to 12 lbs./hour. A typical extruder 22 includes a series of interconnected housings 30. The housings 30 are interconnected by flanges 32 at ends 34 of the housings 30. Feed screws 36 are located within the housings 30. Each housing 30 may have a solitary screw 36 or, as shown in FIG. 2, the housings 30 may include a pair of screws 36.

Again referring to FIG. 1, a power source 40, preferably in the form of an electric motor, is located on an end 42 of the extruder 22. The motor 40 serves to rotate the screws 36, each of the screws 36 being mechanically connected to the motor 40. The screws 36 may be in the form a spiral feed screw 44 for propelling the resin 26 and colorant 24 through the extruder 22 or in the form of kneading screws having either no spiral or a reverse spiral which are used to disperse the other constituents including the colorant 24 into the resin 26. The screws 36 thus within each housing 30 are either of a spiral screw 44 or of a mixing screw 46. Each of the housings 30 thus form zones 50. In a preferred twin screw extruder, there are specific temperature zones 50 along the entire length of the extruder 22 which may be the same or different for each section 30. The zones 50 may include feed zones 52 and mixing zones 54 with each feed zone 52 having at least one feed screw 44 and with each mixing zone 54 having at least one mixing screw 46. In the feed zone 52, resin 26 is metered into the extruder 22. The temperature is maintained below the resin melt point. If the resin begins to melt at the feed port, the entry clogs, and the extruder 22 often stalls.

At a first feed zone 60, the resin 26 is added to the extruder 22. The resin 26 is stored adjacent the extruder 22 in a dry toner resin feeder hopper 62. The resin 26 is uniformly fed from the hopper 62 by an auger 64 to a resin hopper outlet 66. The resin hopper outlet 66 is located adjacent a extruder resin inlet 70 into which the resin 26 is deposited.

After the resin 26 is added to the extruder 22, the colorant 24 is added to the extruder 22. The resin 26 may travel through one or more of the feed zones 52 before entering the area where the colorant 24 is added. The colorant 24 is preferably stored in a separate container such as a colorant tank 70. The colorant 24 at this stage may be either a dispersion of pigment in liquid, a solution of dye or a colorant in a melted state. To accommodate the caustic nature of the colorant solution, the tank 70 is preferably made of stainless steel or contains a glass liner (not shown). The tank 70 is preferably portable and may include rollers 72 to ease the movement of the tank 70. A pump 74 is used to extract the colorant 24 from the tank 70. The pump 74 may be any suitable commercially available non-corrosive pump with sufficient capacity to provide the proper amount of colorant 24 to the extruder 22. A first conduit 76 interconnects the tank 70 to the pump 74. The first conduit 76 is preferably in the form of non-corrosive tubing, such as stainless steel tubing. To change from the extruding of one color toner to another color toner, the colorant tank 70 is preferably quickly disconnectable from the first conduit 76. For example, a quick release connector 80 may be used to connect the tank 70 to the first conduit 76.

A second conduit 82 connects the pump 74 to an injection nozzle 86 in the extruder 22. A valve 90 is located in the second conduit 82 to control the flow of the colorant 24 though the second conduit 82. The second conduit 82, like the first conduit 76 is preferably made of a non-corrosive tubing such as stainless steel tubing. The colorant 24 passes through the pump 74 to the second conduit 82 through the valve 90 to the injection nozzle 86. The colorant 24 within the injection nozzle 86 then enters a high intensity mixing zone 92.

The high intensity mixing zone 92 is shown in more detail in FIG. 2. The high intensity mixing zone 92 includes a high intensity mixing zone housing 94. Extending lengthwise through the housing 94 are first and second high intensity zone extruder barrels 96 and 98, respectively. The barrels 96 and 98 preferably intersect and the nozzle 86 is located in an area between or before the first of the barrels 96 and 98. The resin 26 enters the high intensity mixing zone 92 at an inlet 100 and exits at an outlet 102. The nozzle 86 is located near the inlet 100 but can be located at other positions along the length of the extruder 22 further from the entry position 100. First and second high intensity zone mixing screws 104 and 106 are located in first and second extruder barrels 96 and 98, respectively. The screws 104 and 106 preferably are kneading type screws to assist in mixing the liquid colorant 24 with the resin 26 already in the melted state, thereby providing liquid resin 26 which mixes more readily with the colorant 24. In the mixing zone 92, the temperature of the barrels 96 and 98 are held sufficiently above the resin melting point to keep the conveyed mass in a high viscosity, molten state. Reverse directing screw elements cause the advancing blend to swirl backwards into the forward-moving blend, causing a rise in pressure. In this high energy state, colorant is blended into the molten resin. Colorant and optional additives mix uniformly into the liquified resin. If, during this stage, the temperature is temporarily lowered, the resin viscosity increases. It should be appreciated that the invention may be practiced equally as well with an extruder having a single barrel and a single screw rather than the twin barrels and screws as shown in FIG. 2.

As the colorant 24 is mixed with resin 26, an extrudate 110 is formed which contains the colorant 24 evenly distributed within the resin 26. The screws 104 and 106 are preferably turned at the fastest rate which allows the molten resin to achieve the desired temperatures. Faster screw speeds provide higher energy mixing and greater throughputs, but above a certain rate, the resin 26 is moving too fast to equilibrate with the barrel temperature, and dispersion quality degrades.

Referring again to FIG. 1, the extrudate 110 passes from the high intensity mixing zone 92 to the next adjoining zone 50. The next adjoining zone 50 may be one of the feed zones 52 or one of the mixing zones 54. The extrudate 110 next preferably passes an evaporation zone 112 where conduit 114 passes water into the extruder 22. Due to the heat generated in the high intensity mixing zone 92, the temperature of the extrudate 110 in the evaporating zone 112 is preferably significantly above 100° C. and therefore the water which is added by the conduit 114 to the evaporation zone 112 evaporates into steam which is drawn from the evaporation zone by a vacuum port 116. Along with the steam leaving through the vacuum port 116 are volatile chemicals (not shown) which are likewise drawn from the extruder at the vacuum port 116. The invention may be practiced with either a single evaporation zone 112 or, as shown, a second evaporation zone 118 which also is connected to the vacuum port 116. The extrudate continues to pass through the extruder 22 to a die plate 120 located at an outlet 122 of the extruder 22. The die plate 120 includes an aperture 124 or multiple apertures through which the extrudate 110 exits the extruder 22. At the die plate 120, the temperature is raised from approximately 110° C. to above 200° C. temperature to obtain a temperature which fluidizes the extrudate and causes it to flow freely through the aperture 124. The pressure in the preceding mixing zone can be increased by restricting the size of the aperture 124, at the expense of throughput. The aperture 124 is chosen of suitable size to provide flow sufficient to provide for a commercially acceptable process.

A detector such as a near-infrared (NIR) spectroscopic sensor 130 is located near the die plate, or preferably outside of the extruder 22 near the aperture 124. The near-infrared sensor 130 measures the concentration of the colorant, by comparison of the signal with that of a standard, and hence the color of the extrudate 110 and sends an electrical signal to a feedback controller 132 by way of an electrical conduit 134.

The feedback controller 132 compares the color measured at the aperture 124 to a predetermined desired color and sends an electrical signal through a second electrical signal conduit 136 to a valve control 140 in the form of, for example, an electrical servo motor 140. The servo motor 140 opens or closes the valve 90 in order to allow a correspondingly increasing or decreasing amount of colorant 24 through the valve 90 to the extruder 22. For a modern production process, the extrudate passes through the extruder 22 in a matter of a few seconds. Therefore, the near-infrared sensor 130 can measure the color of the extrudate 110 and make an immediate adjustment in the colorant 24 entering the extruder 22 whereby only a minute amount of extrudate 110 will pass through the extruder 22 before the adjustment is made. It should be appreciated that the feedback controller 132 may include logic including a time delay (not shown) whereby the color of the extrudate 110 is measured by the infra-red sensor 130 only at periodic intervals whereby the feedback system may remain stable.

Figure 4:
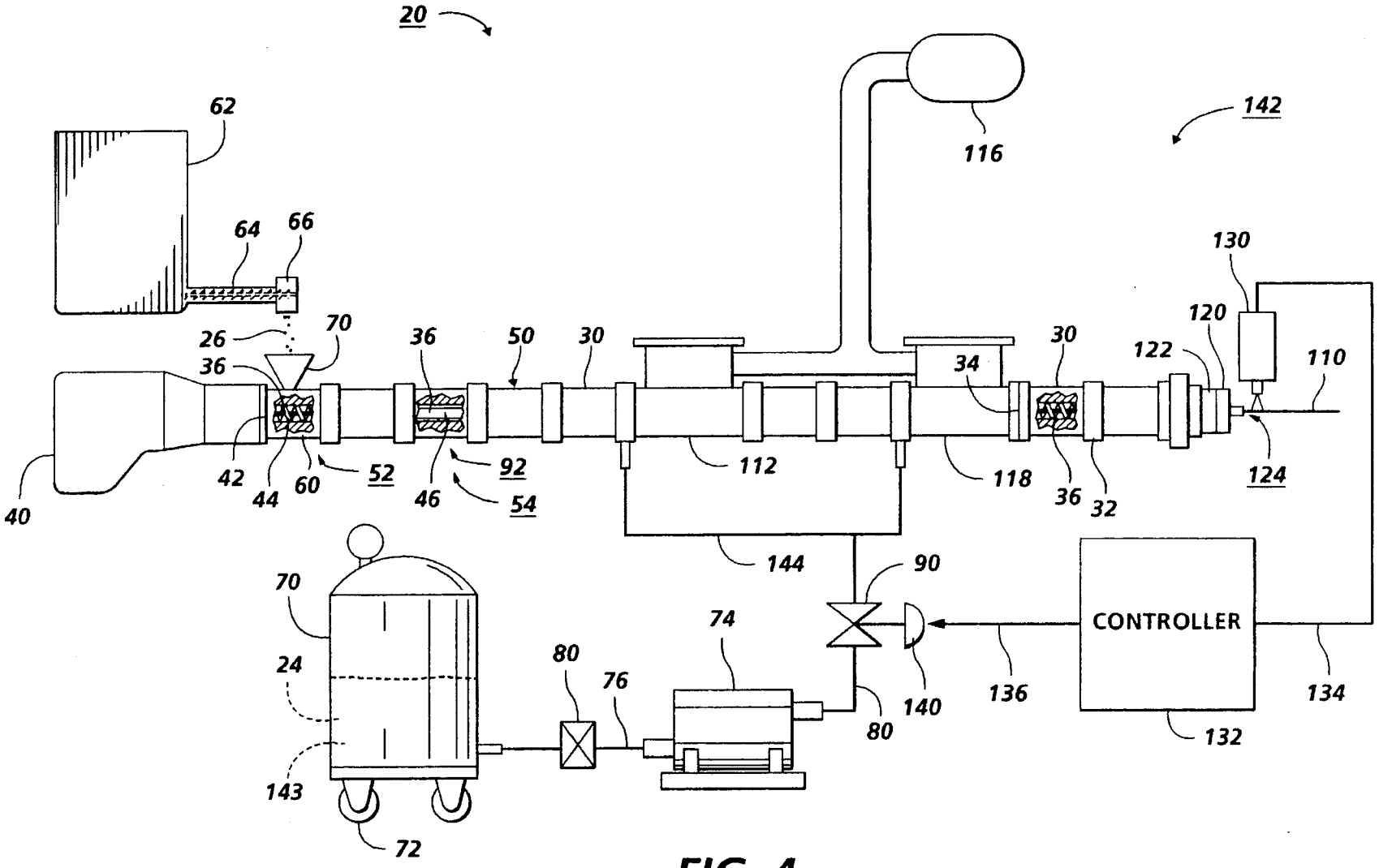
FIG. 4 is a schematic elevational view of an alternate extruder utilizing the colorant injection system of the present invention.

Now referring to FIG. 4, extruder 142 is shown incorporating the present invention. Extruder 142 is similar to extruder 22 of FIG. 1, except, rather than having the colorant 24 enter the extruder 22 at injection nozzle 86 and having water enter the extruder 22 at conduit 114 downstream from the nozzle 86, the colorant 24 and water 143 enter the extruder 142 from a common conduit 144. The water may be combined with the colorant 24 in the tank 70 as shown in FIG. 4 or a separate water line (not shown) may be alternatively connected to conduit 144.

Figure 3:
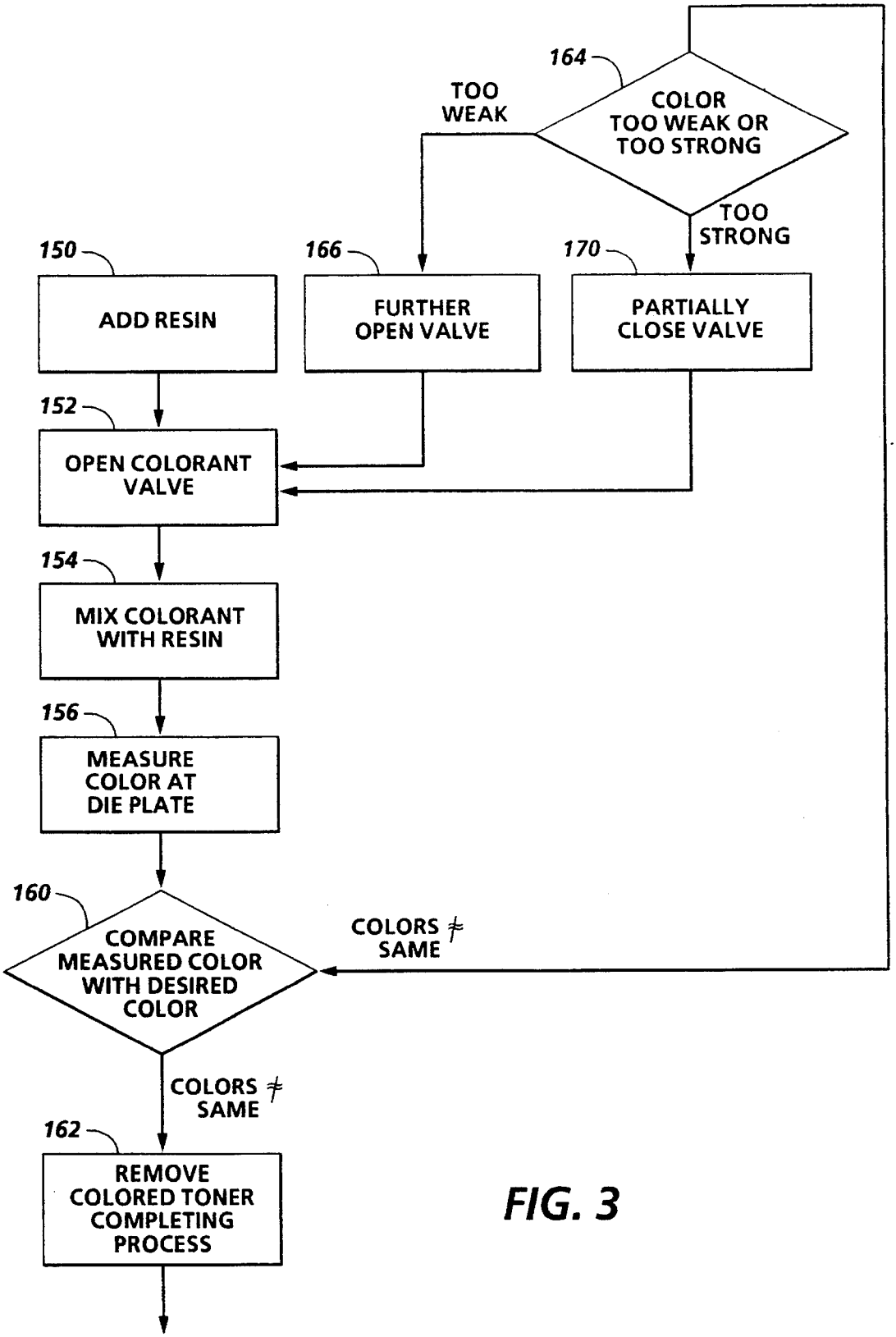
FIG. 3 is a block diagram of the colorant injection system of FIG. 1.

The toner preparing apparatus 20 is shown schematically in FIG. 3. At operational block 150 resin is added to the extruder 22. Next, at operational block 152, the colorant valve 90 is opened. Next, at operational block 154, the colorant 24 is mixed with the resin 26 in the extruder 22. At operational block 156, the near-infrared sensor 130 measures the color. At decision block 160 the measured color is compared with the desired color within the logic of the feedback controller 132. If the measured color of the extrudate 110 is the same or almost the same as the desired color of the extrudate 110, the extruder 22 continues to operate with the valve 90 remaining in its present position and the colored toner is removed in operational block 162 for further processing.

Alternatively, if the measured color of the extrudate 110 is different than the desired color of the extrudate 11(0), a determination is made at decision block 164 whether the color signal of the extrudate 110 is too weak or too strong. If the color signal is too weak, the valve 90 is opened further at operational block 166. Likewise, if the color signal is too strong, the valve 90 is partially closed at operational block 170.

The colorant 24 which now has a revised flow rate is then mixed with resin 26 as shown in operational block 154. As shown in operational block 156, the color of the extrudate 110 is measured by the infra-red sensor 130 and, then as shown in decisional block 160, the measured color of the extrudate 130 is compared with the desired color of the extrudate 110. If the colors are not the same, the decisional block 164 is reached and further adjustment of the valve 90 is made, whereas if the colors are the same, the operational block 162 is reached and the colored toner is removed for further processing.

The extrudate 130 from the extruder 22 is cooled by spray or immersion in water prior to cutting the strands with a rotary knife or other suitable means.

An important property of toners is brittleness which causes the resin to fracture when impacted. This allows rapid particle size reduction in attritors, other media mills, or even jet mills used to make dry toner particles.

After the resin and the colorant have been melt blended together, the resin-colorant mixture is reduced in size by any suitable method including those known in the art.

A pulverizer may be also used for this purpose. The pulverizer may be a hammer mill such as, for example, an Alpine® Hammer Mill. The hammer reduces the toner particles to a size of about 100 μm to about 300 μm.

Prior to pulverizing the toner particles, a rotary cutter, such as an Alpine® Cutter or Fitz® Miller, may be used to reduce the size of the resin particles.

A jet type micronizer such as a jet mill is preferred for micronization. Jet mills contain a milling section into which water vapor jets or air jets are blown at high speeds, and the solid matter to be micronized is brought in across an injector by a propellant. Compressed air or water vapor is usually used as the propellant in this process. The introduction of the solid matter into the injector usually occurs across a feeding hopper or an entry chute.

For example, a Sturtevant 15 inch jet mill having a feed pressure of about 114 psi and a grinding pressure of about 119 psi may be used in the preparation of the toner resin particles. The nozzles of this jet mill are arranged around the perimeter of a ring. Feed material is introduced by a pneumatic delivery device and transported to the injector nozzle. The particles collide with one another and are attrited. These particles stay in the grinding zone by centrifugal force until they are small enough to be carried out and collected by a cyclone separator. A further size classification is performed by an air classifier.

Other methods may be used to reduce the size of the toner, including methods that may be applied when the toner will be used to form a liquid developer. Such methods include, for example, post-processing with an attritor, vertical or horizontal mills or even reducing toner particle size in a liquid jet interaction chamber. Additives such as charge control agents may be added to the liquid developer.

The color feedback system of the present invention provides for real time colorant level adjustment with the ability to fine tune the color of the colored toner produced. When dry pigments are used they must be premixed with the resin providing a requirement for an added process. Dyes may be preferred for their dispersibility if the toner is to be used for making color transparencies.

The use of the separate solution tanks with quick release connectors provides for a quick color change and correspondingly a quick changeover from the production of one color toner to a second color toner. This provides for the use of smaller lots and resulting smaller inventories of colored toner. The use of the solution tanks 70 provides for cleanup of the tank 70 to occur outside of the extruding process.

The use of liquid colorant dyes rather than dry pigments provides for a safer environment in that the heavy metals such as copper, which are required to manufacture the pigments are unnecessary when using the dyes. Furthermore, when pigment dispersions need to be used, the method of the invention has the advantage that the airborne particles in the dry pigments are no longer present.

The use of the colorant dyes provides better disbursement of the color within the extrudate. The better color dispersion helps to provide better quality transparencies. Further, with the improved color dispersion of dyes, it is easier to control triboelectric properties within the colored toner.

While the invention has been described with reference to the structures and embodiments disclosed herein, it is not confined to the details set forth, and encompasses such modifications or changes as may come within the purpose of the invention.

We claim:

1. An apparatus for mixing toner resin with a liquid colorant to form a toner mixture of a selected color, comprising:

a toner extruder having the resin being conveyed therethrough;

means for adding the colorant to the toner resin in said toner extruder to form the toner mixture of a selected color; and means for measuring the color of the toner mixture after mixing in said toner extruder and transmitting a signal indicative of the color.

2. The apparatus of claim 1, further comprising means, responsive to the signal, for controlling addition of the colorant to said toner extruder.

3. The apparatus of claim 1, wherein said adding means comprises:

a container having a supply of colorant;

a conduit connecting said container to said toner extruder; and means for urging the colorant from said container to said toner extruder through said conduit.

4. The apparatus of claim 3, wherein said adding means comprises a nozzle, connected to said conduit, for spraying the colorant into said toner extruder.

5. The apparatus of claim 3, wherein said container comprises a quick disconnect, whereby said container may be quickly replaced.

6. The apparatus of claim 1, wherein said adding means comprises an injector for injecting a liquid colorant selected from the group consisting of dispersions, solutions and melts.

7. A method mixing a toner resin with a liquid colorant to form a toner mixture of a selected color, comprising conveying the toner resin through an extruder;

adding the colorant to the toner resin in the extruder to form the toner mixture of the selected color;

measuring the color of the toner mixture after mixing in the toner extruder; and transmitting a signal indicative of the color in the toner mixture.

8. The method of claim 7, further comprising the step of controlling addition of the colorant to the extruder in response to the signal.

9. The method of claim 7, further comprising the step of connecting colorant chambers to said extruder simultaneously with the step of conveying the toner resin.

* * * * *